US005407136A

United States Patent [19]

West et al.

[11] Patent Number: 5,407,136

[45] Date of Patent: Apr. 18, 1995

[54] INK-JET NOZZLE

[75] Inventors: David B. West, Cambridge; Scott Barraclough, Gloucester, both of Mass.

[73] Assignee: Iris Graphics, Inc., Bedford, Mass.

[21] Appl. No.: 116,980

[22] Filed: Sep. 10, 1993

Related U.S. Application Data

[63] Continuation-in-part of Ser. No. 947,278, Sep. 18, 1992, abandoned.

[51] Int. Cl.[6] ..... B05B 1/00

[52] U.S. Cl. ..... 239/589; 65/109

[58] Field of Search ..... 239/589; 65/57, 54, 65/102, 109, 108; 346/140 R

[56] References Cited

U.S. PATENT DOCUMENTS

| | | | |
|---|---|---|---|
| 1,730,099 | 10/1924 | Tribbett | 239/589 |
| 3,620,457 | 11/1971 | Pearson | 239/589 |
| 4,185,706 | 1/1980 | Baker et al. | 239/589 X |
| 4,813,611 | 3/1989 | Fontana | 239/589 |
| 4,942,296 | 7/1990 | Jones | 250/288 |

FOREIGN PATENT DOCUMENTS

| | | |
|---|---|---|
| 0097413 | 1/1984 | European Pat. Off. . |
| 9014956 | 12/1990 | WIPO . |

OTHER PUBLICATIONS

Galley et al, "Technique for Producing Capillaries with Reproducible Orifice Diameters for Uniform Droplet Generation". Applied Spectroscopy, vol. 46, No. 10, pp. 1460–1463.

*Primary Examiner*—Andres Kashnikow
*Assistant Examiner*—Kevin P. Weldon
*Attorney, Agent, or Firm*—Weingarten, Schurgin, Gagnebin & Hayes

[57] ABSTRACT

A nozzle for an ink-jet printer is provided having a gradually converging inner diameter leading to an orifice less than 15 microns in diameter and having an outer nozzle diameter proximate the orifice at least as great as the outer diameter at other points along the nozzle. The nozzle is produced by heating a vitreous tube while rotating it, until a portion of the tube is sufficiently viscous to cause the inner diameter to converge at an angle between 5 and 25 degrees with respect to the axis of symmetry of the tube, and until the inner diameter is less than a selected orifice diameter. The gradual taper is achieved without drawing or pulling the tube and it facilitates achieving a desired orifice dimension during removal of a portion of the tube having an inner diameter less than the selected orifice diameter. The extremely small orifice size enables an ink-jet printer to deposit droplets of ink sufficiently small to make photographic-quality gray scale and color images.

8 Claims, 2 Drawing Sheets

FIG. 4
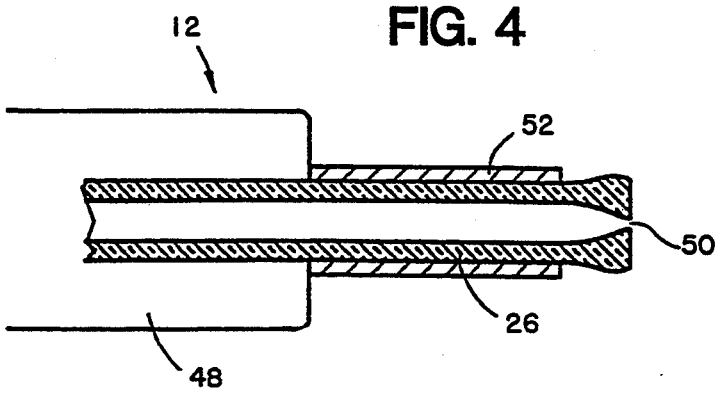
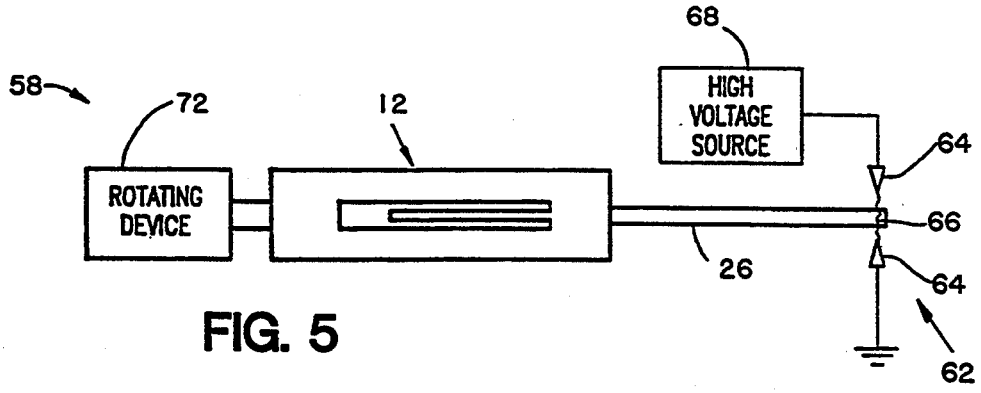
FIG. 5
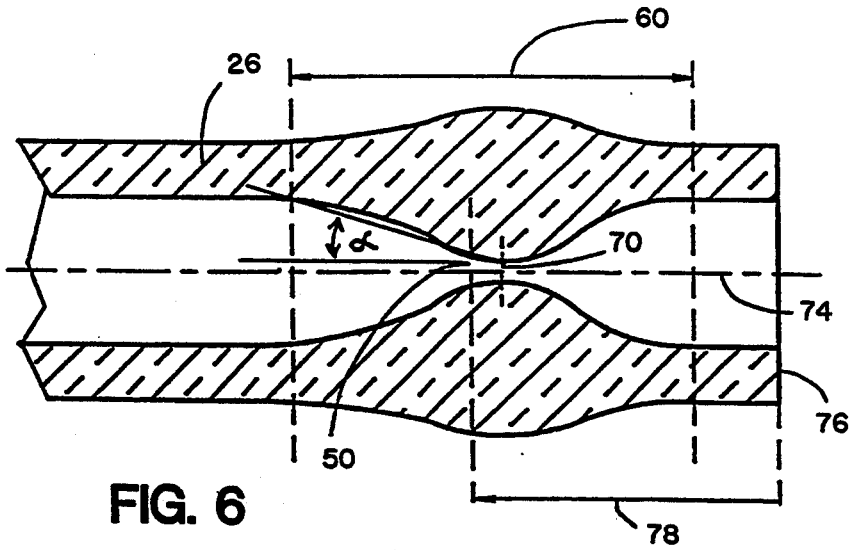
FIG. 6

INK-JET NOZZLE

This application is a continuation-in-part of U.S. application Ser. No. 07/947278, filed Sep. 18, 1992 now abandoned.

FIELD OF THE INVENTION

The present invention relates to ink-jet nozzles generally, and more particularly to a micro-scale nozzle used in high resolution color printing.

BACKGROUND OF THE INVENTION

Ink-jet printers have rapidly gained in popularity as a means for generating high quality gray scale and color images from computer sources. Because of the large drop size produced by most ink-jet printers, the color and gray scale images they produce are limited to less than 100 color or gray tones. Although this is adequate for certain applications such as bar graphs and pie charts, it is unquestionably inadequate for making accurate representations of real-world colors and does not approach a photographic appearance.

An ink-jet device makes color images by physically mixing ink on the print medium to obtain a desired color. Inks for a color ink jet printer are generally selected from one or more of black, magenta, cyan, and yellow.

Presently known devices operating at 300 dpi, wherein each of the dots are sized to fill a $0.08\times0.08$ $mm^2$ picture element (pixel) for example, are limited in the color density and shade, and thus realism that they can provide as a result of this limitation. However, as the number of ink droplets deposited per pixel is increased by making the droplets smaller, it is possible to apply a sufficient number of droplets of ink within a pixel to obtain natural coloring. With respect to gray scale printing, it similarly allows a greater number of shade levels. It is known that a distribution of zero to thirty droplets per $0.08\times0.08$ $mm^2$ pixel, per color creates hundreds of different density levels per color discernable by the human eye. Thus, it would be desirable to provide a group of nozzles capable of providing thirty or more droplets per pixel.

In addition to the appropriate control software and inks, the above described color image production using ink-jet technology requires an ink nozzle capable of consistently dispensing the very small droplets of ink. Any dispersion of ink caused by imperfections in the ink nozzle has disastrous consequences for print quality, especially when the spray pattern of four nozzles must be coordinated.

In order to obtain photographic quality gray scale and color images using an ink-jet device, an ink nozzle with an orifice approximately 15 microns or less in diameter is required. It is known in the art to fabricate ink nozzles from glass, but because of the difficulty in manufacturing a nozzle from a glass tube having such a small orifice size, it is desirable to provide a method of consistently providing nozzles of the precise dimensions needed.

One prior art ink nozzle is illustrated in U.S. Pat. No. 3,393,988 to Blumenthal, wherein a nozzle having an orifice 0.003 to 0.0004 inches is formed by heating the lower end of a vertically oriented, low melting point, glass tube with a flame burner until it melts into a teardrop shape under the influence of gravity, thereby forming a converging inner passage that is abruptly tapered (60° to 90° with respect to the central axis of the passage). Glass at the end of the tube is then removed to establish an abruptly converging passageway with a central orifice which is subsequently flame polished to provide smooth surfaces.

It should be noted that Blumenthal's requirement that the tube be oriented vertically, due to the technique's reliance on the force of gravity, is a severe manufacturing limitation. It should also be noted that Blumenthal specifically teaches away from a gently tapered converging portion leading to the orifice. Were such an abruptly tapered end as shown in Blumenthal be ground in an attempt to provide an orifice ten times smaller, with the perfection and symmetry required by photographic quality color printing, the results would be uncertain. Furthermore, even if a 15 micron or less diameter orifice were to be obtained, the flame polishing step of Blumenthal would produce an unacceptable change in the diameter of the orifice with respect to the requirements for the above described color printing application.

The drawing or pulling method of making a converging passage, specifically rejected by Blumenthal, is described in U.S. Pat. Nos. 3,985,535 and 4,111,677. As Blumenthal indicates, drawing a glass tube causes a reduction in passage diameter gradually over such an extended distance that it causes fluid flow problems. In order to draw a glass tube, a relatively large portion of the tube must be made molten and glass in its molten state is very hard to dimension with accuracy.

Additionally, pulling a heated glass tube to cause narrowing of a central passage causes a concomitant reduction in wall thickness. The resulting drawn portion of the glass tube is therefore extremely fragile even at the diameters taught by Blumenthal, and is extraordinarily so in a tube one tenth the size. The susceptibility of the drawn glass nozzle to material failure is exacerbated by the forces applied by a mechanically stimulated piezo-electric crystal used in some ink-jet devices to assist in uniform droplet formation. Reinforcement of the fragile drawn tube is demonstrated in a fluid dispensing device, the 9103557E173E manufactured by Siemens-Elma AB of Sweden, which provides a metal sheath over the tube, except in the area of the orifice where the tube is uncovered.

Therefore, in addition to the other above-recited features lacking in the prior art, it would be desirable to provide a tube having an inner wall leading to an orifice with a less extensive taper than a drawn tube, yet more taper than the Blumenthal tube, with an orifice in the fifteen micron or less range. It would further be desirable to form such a tube without weakening it so that it is unmanageably fragile or so that it requires reinforcement.

SUMMARY OF THE INVENTION

In surmounting the foregoing disadvantages, the present invention provides a fluid-dispensing nozzle having an inner passage that tapers to an orifice approximately fifteen microns or less in diameter, making possible the creation of photographic-quality gray scale and color images using an ink-jet printer. The nozzle provides a perfectly symmetrical fluid dispensing inner passage having a gentle taper formed without pulling or drawing the glass tube, and can be fabricated in any orientation from the horizontal to the vertical. The inner passage provides a taper having an angular change with respect to the axis of symmetry of the nozzle sufficient to minimize fluid flow problems encountered in drawn tubes without being an abrupt taper, while the outer diameter of the nozzle in the area of the orifice is at least as large as along the remainder of the nozzle's length. The nozzle is fabricated so that exceptional accuracy is possible during an orifice dimensioning step of fabrication. Furthermore, the nozzle is sufficiently robust to withstand repeated vibration and sudden printhead movement without reinforcement.

In accordance with the invention, a nozzle for an ink-jet nozzle is provided having a gradually converging inner diameter leading to an orifice less than 15 microns in diameter and having an outer nozzle diameter proximate the orifice at least as great as the outer diameter at other points along the nozzle.

The nozzle is produced by heating a tube while rotating it, until a portion of the tube is sufficiently viscous to cause the inner diameter to converge at an angle between 5 and 25 degrees with respect to the axis of symmetry of the tube, and until the inner diameter is less than a selected orifice diameter. A length of tube is then removed having an inner diameter less than the selected orifice diameter and mechanically shaped to the correct hole size.

The ink-jet nozzle of the invention is central to a printing process, wherein a printhead having a plurality of nozzles supplied with ink is responsive to a computer system capable of generating color raster image data. In accordance with the color raster image data, the printhead deposits ink droplets from one or more of the nozzles in the pixels required to form a two-dimensional image. The nozzles are supplied with black ink for gray scale images and differently colored inks for color images.

BRIEF DESCRIPTION OF THE DRAWINGS

A more complete understanding of the present invention and attendant advantages and features thereof will be more readily understood by reference to the following detailed description when considered in conjunction with the accompanying drawings wherein:

FIG. 4 is an enlarged cross-sectional view of the nozzle of FIG. 2;

FIG. 5 is a partially schematic, partially block diagram illustration of an apparatus useful in producing the nozzle of FIG. 4; and FIG. 6 is a sectional illustration of a glass tube after operation of the apparatus illustrated in FIG. 5.

DETAILED DESCRIPTION OF A PREFERRED EMBODIMENT

Figure 1:
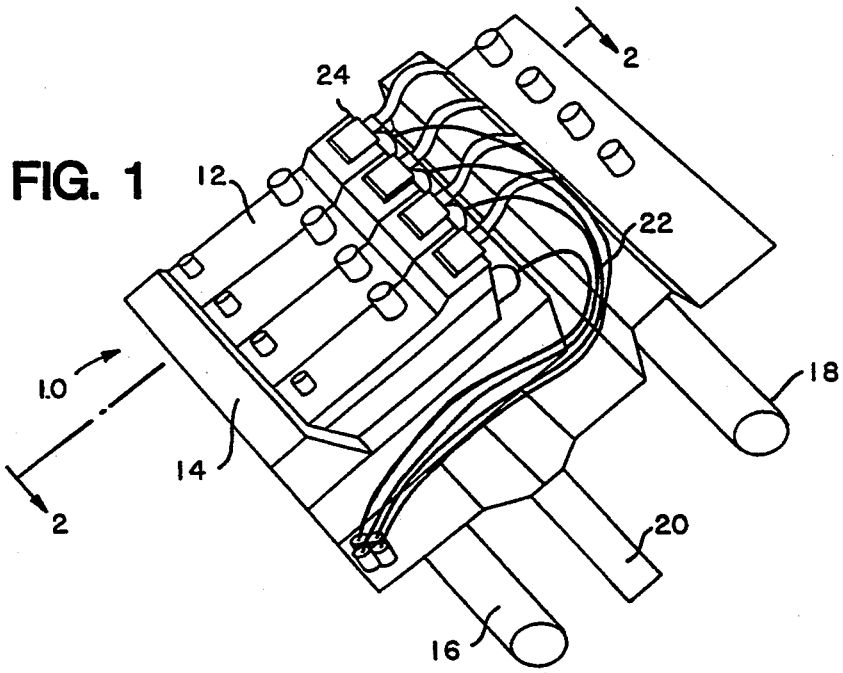
FIG. 1 is a perspective view of a printhead for a color printer having four ink nozzle assemblies.

FIG. 1 illustrates a printhead lid for an ink-jet printer capable of gray scale and color printing, the printhead 10 including four ink nozzle assemblies 12 and a deflection assembly 14. The printhead 10 is movable along first and second guide bars 16 and 18, respectively, in response to software controlled movement of a guide belt 20. Each of the ink nozzle assemblies 12 is provided with an ink line 22 connected to an ink supply (not shown) containing a water-soluble ink. In the exemplary embodiment, the printhead 10 dispenses four different colors of ink: cyan, magenta, yellow, and black. A single piston pump (not shown) is associated with each nozzle assembly 12 and provides calibrated amounts of the selected ink on demand. Each nozzle assembly 12 is provided electrical power through a suitable electrical connector 24.

Figure 2:
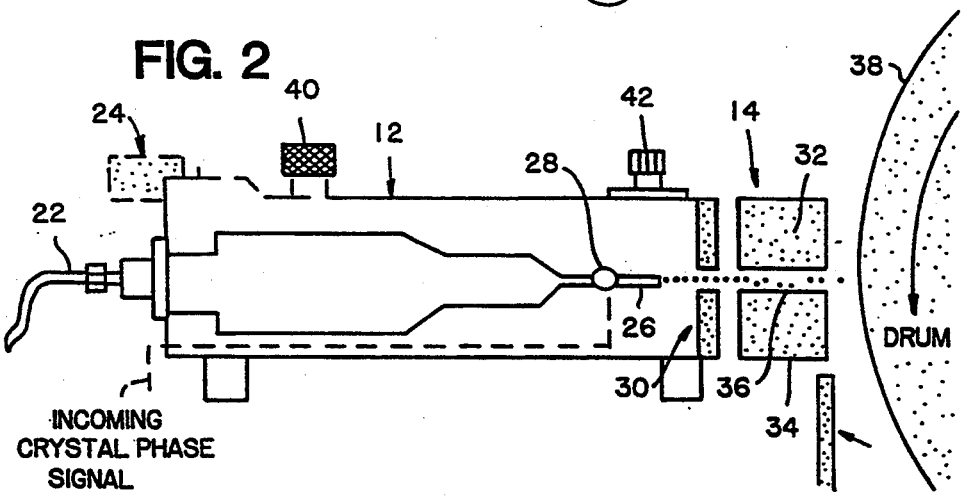
FIG. 2 is a cross-sectional view of one of the ink nozzle assemblies, taken along line 2—2 of FIG. 1.

Referring to FIG. 2, a portion of the printhead 10 is shown in cross-section to illustrate further details of a single nozzle assembly 12 and a portion of the deflection assembly 14. Ink under high pressure is forced through a glass capillary tube 26 that has an orifice approximately fifteen microns or less in diameter. A continuous stream of ink exits at a speed of about 50 meters per second and then spontaneously breaks up into a stream of discrete droplets. To ensure proper droplet formation, the glass capillary 26 is mechanically stimulated by a piezo-electric crystal 28. By applying a signal of one MHz to the crystal 28, one million equally sized droplets are formed every second.

During droplet formation, the ink stream is proximate an electrode 30 which is responsive to a computer system able to generate color raster image data, and the ink droplets formed are charged or left neutral depending on the image data. For example, application of a positive voltage between the electrode 30 and the ink stream causes the ink droplets to be negatively charged.

Subsequent to charging, the droplets pass into the deflection assembly 14 which includes a chargeable upper and lower deflector 32 and 34, respectively, which when appropriately charged attract and/or repel, and thus deflect charged droplets, causing them to strike a knife edge 36, whereupon the droplets are directed into a waste ink disposal system (not shown). Only neutral droplets reach the print media affixed to a rotating drum 38. By switching the signal voltage to the electrode 30 on and off at a maximum frequency equal to the droplet formation frequency, each droplet can be individually controlled to either be caught below the knife edge or deposited on the print media. It is important that every droplet be either fully charged or uncharged. Partly charged drops will be incorrectly deflected and misplaced on the print media, which will degrade print quality. Synchronization of the droplet charging with droplet formation alleviates this problem. Adjustment knobs 40 and 42 are provided for adjusting the knife edge 36 and vertical convergence, respectively.

While the drum 38 is rotated, a stepping motor slowly moves the printhead 10, via the belt 20 axially with respect to the drum 38. By monitoring the drum and printhead position, each pixel along a line can be addressed. In the illustrated embodiment, each pixel has a size of $0.08 \times 0.08$ mm$^2$ which gives 300 dots per inch. The 15 micron or less diameter of the capillary tube 26 enables production of droplets that are so small that they do not cover the entire area of a pixel. However, by increasing the number of droplets deposited in a given pixel, the dot size can be increased. Because each droplet is individually controllable, the number of droplets deposited in a single pixel can be varied from zero to more than thirty. Accordingly, a corresponding number of discrete density steps, true halftones, are obtainable in each pixel for each color.

Figure 3:
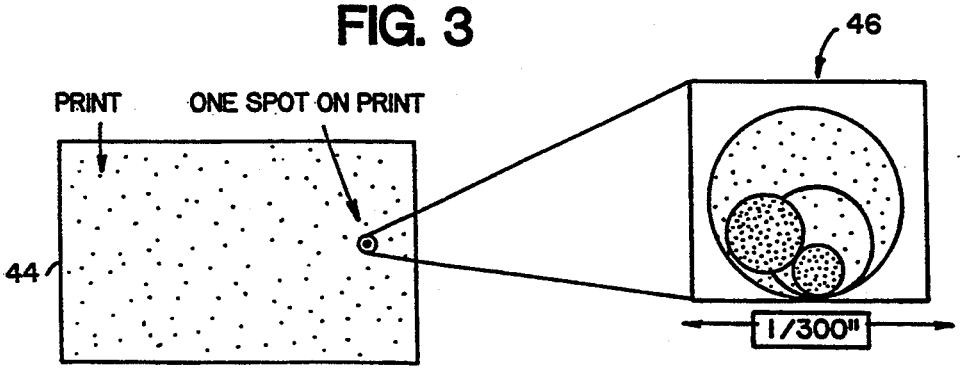
FIG. 3 illustrates formation of variably sized dots and their placement within a pixel using the nozzle illustrated in FIG. 2.

Referring now to FIG. 3, a printed piece of paper 44 is shown with one 1/300" pixel 46 illustrated in greater detail to show exemplary size and placement control of the droplets. This control permits a variety of printing techniques to accommodate different requirements. For example, dot-on-dot placement results in images with sharp edges and minimal image patterning. A second technique, minimal dot-on-dot overprinting between colors, reduces the degree of rainbowing and striation in prints, an effect similar to using a different screen angle in conventional printing. A third technique involves printing dots in patterns that resemble rosettes for the three primary colors (cyan, magenta, and yellow) to minimize dot-on-dot overprinting between colors.

Although the exemplary printhead 10 is configured for a 300 dpi resolution, the ability to alter each dot (or pixel), thanks to the small droplet size enables the resolution to appear to be 1500–1800 dpi. A critical component of the printhead which enables it to produce the small droplets is the capillary tube 26 which has an orifice of less than fifteen microns.

FIG. 4 is a cross-sectional view of a portion of a nozzle assembly 12 including a housing 48 and a capillary tube 26 having an orifice 50 at one end. In an exemplary embodiment of the present invention, the capillary tube 26 is comprised of thick-walled glass tubing, such as Flexible Fused Silica Capillary Tubing, TSP100530 manufactured by Polymicro Technologies Inc., Phoenix, Ariz., typically used for gas chromatography. Fused silica has a melting temperature of approximately 1,600° C. and is much less fragile than ordinary glass.

The above-described capillary tube 26 has generally a 500 micron outer diameter and a 100 micron inner diameter which inner diameter is precisely controlled and concentric. The thick walls provide rigidity and strength to the tubing. Furthermore, the product manufactured by Polymicro Technologies Inc. is covered on the outside by a thin layer of plastic 52 which protects the tube, although this protective layer is not necessary.

From the illustration, it is notable that the orifice end of the tube 26 neither necks down nor is thinner walled than the remainder of the tube as would be the case with a drawn tube. Typically, the outer diameter of the tube 26 of the invention, in the vicinity of the orifice 50, is 2.5%–9% larger than the outer diameter of the remainder of the tube. In this embodiment, the plastic layer 52 is removed in the area of the orifice 50.

Thick-walled tube material is advantageous because it provides rigidity during the manufacturing process. It also advantageous to use thick-walled tube material having an inner diameter approximating the diameter of a desired orifice 50, thereby minimizing the extent of distortion of the inner diameter which occurs during the forming process.

The orifice 50, produced in the tube 26 in a manner described in more detail hereinbelow with respect to FIG. 5, typically has a diameter approximately ten times smaller than the inner diameter of the remainder of the tubing, although any extent of reduction is possible. For applications having paper as the print medium (or another material with similar surface characteristics), the diameter of orifice 50 is approximately 10 microns, or more specifically 9.7±0.5 microns. For printing on textiles that absorb ink more readily than most papers, the diameter of the orifice 50 is approximately 15 microns.

Reference is now made to FIGS. 5 and 6. FIG. 5 illustrates an apparatus 58 for creating a "pre-orifice" 60, or preliminary version of the orifice 50 as shown in FIG. 6. The apparatus 58 typically comprises an arc forming unit 62, such as the PFS300-26 Fusion Fiber Splicer manufactured by Power Technology Inc., Little Rock, Ark. The arc forming unit 62 comprises two electrodes 64, placed close to, but not at, the end of tube 26 for creating an electric arc 66 with which to soften the tube 26. One of the electrodes 64 is grounded and the other electrode 64 is in electrical communication with a high voltage source 68. Typically, the amount of heat generated by the arc forming unit 62 and the length of time the heat is provided to the tube 26 are controllable by operating the arc forming unit 62 in a pulsed manner such as by pulsing high voltage source 68. Lasers, masked or confined flames or plasmas or other sources of controllable concentrated heat can alternatively be utilized as long as they are able to achieve temperatures capable of softening the fused silica tube 26 which has a melting temperature of approximately 1,600° C., and can heat the selected section of tubing rapidly enough such that the heating remains proximate to said section. An ordinary gas burner, such as a bunsen burner, is incapable of performing this task.

The electric arc 66 generates enough heat to reduce the viscosity of the tube 26 in the area of pre-orifice 60, and the heat is greatest at the central area of the pre-orifice 60. Surface tension forces on the reduced viscosity material cause the area to assume a generally spherical shape (as seen in FIG. 6), thereby locally reducing the inner diameter of the tube 20 and generally increasing its outer diameter.

As can be seen from FIG. 6, in the area of the pre-orifice 60, the inner diameter has an hour glass shape, tapering from the inner diameter of the remainder of the tube 26 to the inner diameter of pre-orifice 60 at an angle of convergence "$\alpha$" which is between 5 and 25 degrees with respect to the central axis of the tube 26, without completely closing off the pre-orifice. The inner diameter of the tube 26 then increases in diameter until reaching the end of the tube 26. The narrowest point in the interior of the tube 26, labeled 70, is known as the vena contracta.

Because arc 66 provides very concentrated heat, a relatively narrow segment of the tubing is made somewhat viscous. The degree and length of time of heating are generally tightly controlled so that the glass of the heated segment does not run, drip, or otherwise exhibit the influence of gravity, nor is it dependent thereon for assuming the required shape. Therefore, the heating of the tube 26 can be performed horizontally or at any other non-vertical position and no external drawing or axial pulling is applied. Accordingly, the increase in the outer diameter is larger than occurs in the manufacturing of prior art nozzles, all of which utilize drawing forces or are otherwise influenced by gravity or other external forces, providing the tube 26 of the present invention with a robust tip.

The arc 66 is operated until the diameter of the vena contracta 70, located, in one embodiment of the present invention, close to but not at the end of the glass tube 10, is at or below a predetermined value, typically equal to or smaller than (but not closed) the desired diameter of the orifice 50. Orifice 50, with a diameter equal to or larger than the vena contracta 70, is at or on the housing side of the vena contracta. Heating other than at the end of the tube 26 is beneficial in that the end of the tube does not require any preparation. Additionally, heating at other than at the end permits the material to be ground back so as to ensure that the orifice 50 is not angled.

To ensure that the hour glass shape of the inner diameter is concentric and that pre-orifice area is evenly heated, the nozzle 26 is rotated during heating typically via a rotating device 72, such as a motor or a rotary joint. This also ensures that the axis of symmetry of the orifice 50 is collinear with an axis of symmetry 74 of the tube 26. Rotation is possible over a broad range of rates, such as 50 to 1500 RPM.

After heating, the material between the end 76 of tube 26 and the orifice 50 is removed, typically via grinding but any other suitable method can be used. The removal is indicated in FIG. 6 by an arrow 78. A significant advantage of the present invention is evident during this critical dimensioning step, wherein the gradual restriction of the vena contracta 70 allows a more controlled grinding or material removal to be performed. In an exemplary embodiment, the vena contracta 70 is ground back from 9.5 microns to 9.7 microns, an orifice diameter required to make the extremely high quality images described hereinabove. Were the taper to be abrupt, the removal of sufficient material to cause such a change in diameter would be almost impossibly difficult to achieve using present manufacturing methods, with predictable precision.

In an alternative embodiment of the present invention, arc 66 is placed at, close to, or slightly away from end 76 of tube 26. The vena contracta 70 formed thereby can be directly used as the orifice 50, without having to remove any material.

It will be appreciated by persons skilled in the art that the present invention is not limited to what has been particularly shown and described hereinabove. A variety of modifications and variations are possible in light of the above teachings without departing from the scope and spirit of the invention, which is limited only by the following claims.

What is claimed is:

1. A nozzle for an ink-jet printer comprising:

a heat softenable tube defining an ink passageway having an axis of symmetry, a first outer diameter, and a first inner diameter;

said first inner diameter converging to an orifice having a second inner diameter of between less than or about 15 microns at an angle of convergence between 5 and 25 degrees with said axis of symmetry; and a second outer diameter that is larger than said first outer diameter proximate said orifice.

2. The nozzle of claim 1, wherein said orifice has an axis of symmetry collinear with said axis of symmetry of said tube.

3. The nozzle of claim 1, wherein said tube comprises fused silica having a melting temperature of approximately 1,600° C.

4. The nozzle of claim 3, wherein a portion of said vitreous tube is covered with a layer of plastic.

5. The nozzle of claim 1, wherein said second outer diameter is 2.5% to 9% larger than said first outer diameter proximate said orifice.

6. A nozzle according to claim 1, and wherein said ink passageway is narrowest at a downstream end thereof.

7. A nozzle according to claim 1, and wherein said tube comprises glass.

8. An ink-jet printing process, comprising the steps of:

providing a computer system capable of generating color raster image data and print command signals;

providing a printhead responsive to said computer system, said printhead including, a plurality of nozzles, each said nozzle having, a heat softenable tube defining an ink passageway having an axis of symmetry, a first outer diameter, and a first inner diameter;

said first inner diameter converging to an orifice having a second inner diameter of between less than or about 15 microns at an angle of convergence between 5 and 25 degrees with said axis of symmetry; and a second outer diameter that is larger than said first outer diameter proximate said orifice;

a plurality of piezo-electric crystals, one said piezoelectric crystal associated with each said nozzle for mechanically stimulating said nozzle;

a plurality of electrodes, one said electrode associated with each said nozzle for imparting an electric charge to droplets of ink ejected from said nozzle;

a deflection assembly including a chargeable deflector for attracting and deflecting charged ink droplets;

providing ink to said plurality of nozzles; and depositing ink droplets from said printhead in accordance with said color raster image data in each of a plurality of pixels, thereby forming an image.

* * * * *

UNITED STATES PATENT AND TRADEMARK OFFICE

CERTIFICATE OF CORRECTION

PATENT NO. : 5,407,136

DATED : April 18, 1995

INVENTOR(S) : David B. West, et al.

It is certified that error appears in the above-indentified patent and that said Letters Patent is hereby corrected as shown below:

Column 3, line 60, "printhead lid" should read --printhead 10--.

Signed and Sealed this

Fifth Day of March, 1996

Bruce Lehman

*Attest:*

BRUCE LEHMAN

*Attesting Officer*

*Commissioner of Patents and Trademarks*